US008442418B2

(12) United States Patent
Koga et al.

(10) Patent No.: US 8,442,418 B2
(45) Date of Patent: May 14, 2013

(54) IMAGE FORMING APPARATUS HAVING DOOR TO ACCESS JAMMED SHEETS

(75) Inventors: Hiroto Koga, Abiko (JP); Hajime Sekiguchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/790,104

(22) Filed: May 28, 2010

(65) Prior Publication Data

US 2010/0329737 A1 Dec. 30, 2010

(30) Foreign Application Priority Data

Jun. 30, 2009 (JP) ..... 2009-155303

(51) Int. Cl.
*G03G 21/00* (2006.01)

(52) U.S. Cl.
USPC ..... 399/124

(58) Field of Classification Search ..... 399/124, 399/107, 110; 312/292, 328, 327
See application file for complete search history.

(56) References Cited

FOREIGN PATENT DOCUMENTS

| | | | | |
|---|---|---|---|---|
| JP | 11249360 | A | * | 9/1999 |
| JP | 2003-137453 | | | 5/2003 |
| JP | 2003186370 | A | * | 7/2003 |
| JP | 2004029271 | A | * | 1/2004 |
| JP | 2007316476 | A | * | 12/2007 |
| JP | 2009179441 | A | * | 8/2009 |

* cited by examiner

*Primary Examiner* — Walter L Lindsay, Jr.
*Assistant Examiner* — Milton Gonzalez
(74) *Attorney, Agent, or Firm* — Canon USA Inc IP Division

(57) ABSTRACT

An image forming apparatus includes a conveyance unit configured to convey a sheet, a first door that can make the conveyance unit accessible, a rotation shaft configured to rotatably support the first door, and a second door which is provided to the first door in an openable/closable manner, wherein the second door can make the conveyance unit near the rotation shaft accessible.

4 Claims, 6 Drawing Sheets

IMAGE FORMING APPARATUS HAVING DOOR TO ACCESS JAMMED SHEETS

BACKGROUND OF THE INVENTION

1. Field of the Invention

The present invention relates to an image forming apparatus which has a door that can be opened and closed when processing such as sheet jam handling and maintenance is performed.

2. Description of the Related Art

An image forming apparatus such as a copying machine and a printer has an openable/closable door that can make a sheet conveyance path or inside of the apparatus accessible for maintenance and sheet jam handling (hereinafter, referred to as jam).

In some image forming apparatuses, a conveyance guide forming a sheet conveyance path is partly disposed at the door. Opening of the door makes the sheet conveyance path accessible for removal of a jammed sheet therein.

In some image forming apparatuses, an image forming unit and a sheet feed unit which feeds a sheet therein to the image forming unit are vertically arranged, and a sheet conveyance path is vertically provided therebetween at a side portion of a body of the image forming apparatus. In the image forming apparatuses, a door for removing a jammed sheet is provided such that a rotation center thereof is disposed at a lower portion of a side face of the image forming apparatus, so that the door can be opened from the topside thereof to make the conveyance path accessible.

Japanese Patent Application Laid-Open No. 2003-137453 discusses an image forming apparatus having the above configuration in which a conveyance guide from a sheet feed unit to an area downstream of an image forming unit is provided beside a door, so that an entire area from the sheet feed unit to the area downstream of the image forming unit becomes accessible by opening the door. This configuration enhances the visual recognition of a sheet jammed in a sheet conveyance path, resulting in easy finding of the jammed sheet.

However, the conventional image forming apparatus as described above does not provide good workability for removing a sheet jammed around the rotation center of the door (hereinafter, referred to as jam handling capacity). In the apparatus, when the door is open, a jammed sheet can be easily recognized, but cannot be easily removed because the area around the rotation center is not accessible from the top side of the door due to a long distance therebetween.

SUMMARY OF THE INVENTION

The present invention is directed to an image forming apparatus that can improve jam handling capacity for removing a sheet that is jammed around a rotation center of a door of the apparatus.

According to an aspect of the present invention, an image forming apparatus includes a conveyance unit configured to convey a sheet, a first door that can make the conveyance unit accessible, a rotation shaft configured to rotatably support the first door, and a second door which is provided to the first door in an openable/closable manner, wherein the second door can make the conveyance unit near the rotation shaft accessible.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
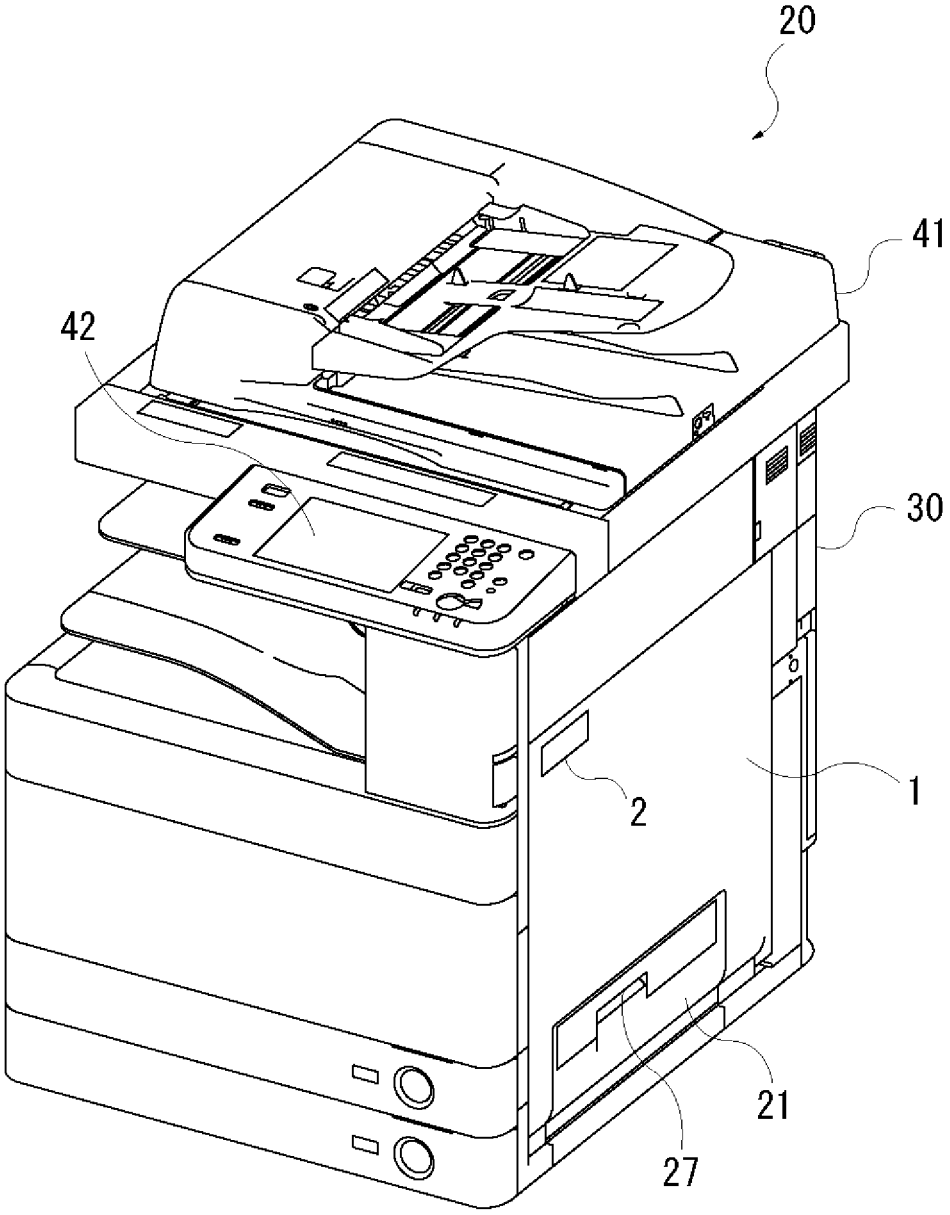
FIG. 1 is a perspective view illustrating an image forming apparatus according to an exemplary embodiment of the present invention.

FIG. 1 is a perspective view illustrating an image forming apparatus that has first and second doors according to an exemplary embodiment of the present invention. An image forming apparatus 20 has an image forming apparatus body 30 (hereinafter, referred to as apparatus body). The apparatus body 30 is provided with a document reading unit 41 at an upper portion thereof. The document reading unit 41 includes an image sensor for irradiating a document with light and converting reflected light into digital signals. The document reading unit 41 is provided with a monitor 42. A first door 1 and a second door 21 of the present invention are provided on a right-side wall of the apparatus body 30 such that the doors can be opened and closed, which will be described later.

Figure 2:
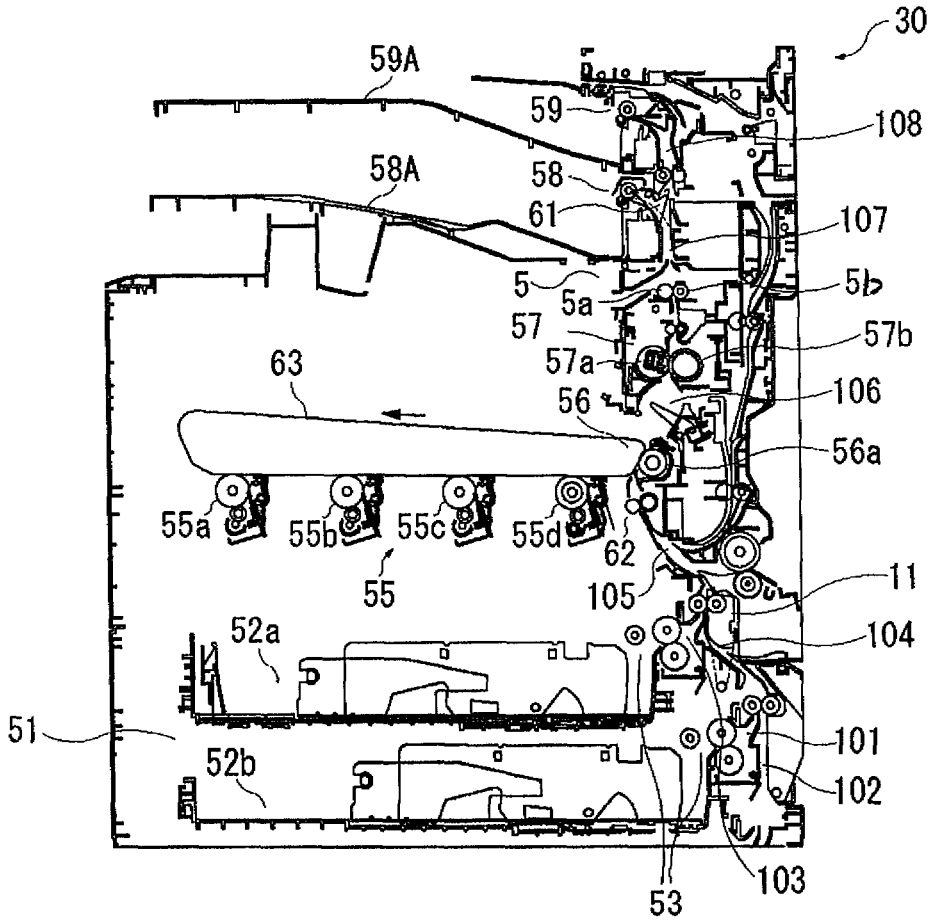
FIG. 2 is a cross sectional view illustrating the image forming apparatus according to the exemplary embodiment of the present invention.

With reference to FIG. 2, operations of the apparatus body 30 will be described. An image forming unit 55 includes photosensitive drums 55*a* to 55*d*, a scanner unit (not illustrated), an intermediate transfer belt 63, and a secondary transfer unit 56. The photosensitive drums 55*a* to 55*d* form yellow, magenta, cyan, and black toner images respectively. The scanner unit (not illustrated) irradiates the photosensitive drums with laser beams based on image information to form electrostatic latent images thereon. The intermediate transfer belt 63 is transferred the toner images from the photosensitive drum 55*a* to 55*d* and transfers them to the secondary transfer unit 56.

When the image formation is started, the document reading unit 41 reads a document image. Based on the read document image information, the scanner unit (not illustrated) irradiates the surfaces of the photosensitive drums 55*a* to 55*d* which are uniformly charged with a predetermined polarity and potential with laser beams for exposure. Accordingly, yellow, magenta, cyan, and black latent images are formed on the photosensitive drums 55*a* to 55*d* respectively.

The latent images on the photosensitive drum 55*a* to 55*d* are developed, respectively, by applying yellow, magenta, cyan, and black toners to form yellow, magenta, cyan, and black toner images on the photosensitive drum 55*a* to 55*d*. The intermediate transfer belt 63 is applied transfer bias and rotationally drives in a direction illustrated by an arrow. Then, the toner images formed on the photosensitive drum 55*a* to 55*d* are transferred to the intermediate transfer belt 63 (primary transfer) to form a full-color toner image on the intermediate transfer belt 63. When a conveyed sheet passes through the secondary transfer unit 56, the toner image on the intermediate transfer belt 63 is transferred to the sheet (secondary transfer) by a bias applied to a secondary transfer roller 56*a*.

A configuration of a sheet feed unit 51 that conveys a sheet to the secondary transfer unit 56 in the image forming unit 55, and a conveyance path for feeding the sheet from the sheet feed unit 51 will be described.

The sheet feed unit 51 is disposed in the lower portion of the apparatus body 30, and includes sheet cassettes 52*a* and 52*b* that can store sheets to be fed to the image forming unit 55, and a sheet feed units 53 for feeding the sheet from the sheet cassettes 52*a* and 52*b*. The sheet cassettes 52*a* and 52*b* can be pulled out of the apparatus body 30 at the front side (an operation side of the image forming apparatus) thereof for replenishment and replacement of sheets. The sheet feed units 53 are respectively provided with pickup rollers 16 and 26 and separating units. The pickup rollers 16 and 26 each contact with top surfaces of sheets in the sheet cassettes 52*a* and 52*b* for feeding, and the separating units each separate the sheets fed from the pickup rollers 16 and 26 one by one. The sheet feed units 53 are located adjacent to a first conveyance path 101.

The separating units are provided, respectively, with feed rollers 14 and 24 which rotate in the sheet feeding direction, and retard rollers 15 and 25 that are in contact with the feed rollers 14 and 24 by pressure and driven in the direction to retract the sheets. The sheets fed by the pickup roller 16 or 26 are individually separated between the feed roller 14 and the retard roller 15 or between the feed roller 24 and the retard roller 25 to be fed downstream thereof. The sheet fed from the sheet cassettes 52*a* or 52*b* is guided along the first conveyance path 101 or a third conveyance path 103 respectively.

Not illustrated, but another sheet feed unit may be optionally added to the lower portion of the image forming apparatus 20. When an optional sheet feed unit with a sheet cassette is added, a sheet fed from the sheet cassette is conveyed to a second conveyance path 102 of the image forming apparatus 20.

Sheets in the sheet cassette 52*a* or 52*b* are guided along the first conveyance path 101 or the third conveyance path 103 to a fourth conveyance path 104. Sheets from the optional sheet feed unit are guided along the second conveyance path 102 to the fourth conveyance path 104. The sheets are then conveyed through the fourth conveyance path 104 and a fifth conveyance path 105 to a registration roller pair 62 disposed downstream therefrom. The registration roller pair 62 corrects skew of each of the conveyed sheets, and further conveys the sheet to the secondary transfer unit 56 at an appropriate timing such that a leading edge of a full-color toner image on the intermediate transfer belt 63 is aligned with a leading edge of the sheet.

The conveyance path of a sheet after transfer of a toner image thereto in the secondary transfer unit 56 will be described. The sheet to which the toner image is transferred passes through a sixth conveyance path 106 and is heated and pressurized by a fixing unit 57 that includes a pair of fixing rollers 57*a* and 57*b* for fixing the toner image. The sheet on which the toner image is fixed is conveyed by a conveyance roller pair 5 including conveyance rollers 5*a* and 5*b* through a seventh conveyance path 107 to a switching member 61 that is illustrated in FIG. 2.

In FIG. 2, when the switching member 61 is disposed at a position illustrated by a dashed line, the sheet is discharged to a first discharge unit 58A by a first discharge roller pair 58. When the switching member 61 is disposed at a position illustrated by a solid line, the sheet is discharged through an eighth conveyance path 108 to a second discharge unit 59A by a second discharge roller pair 59.

Figure 3:
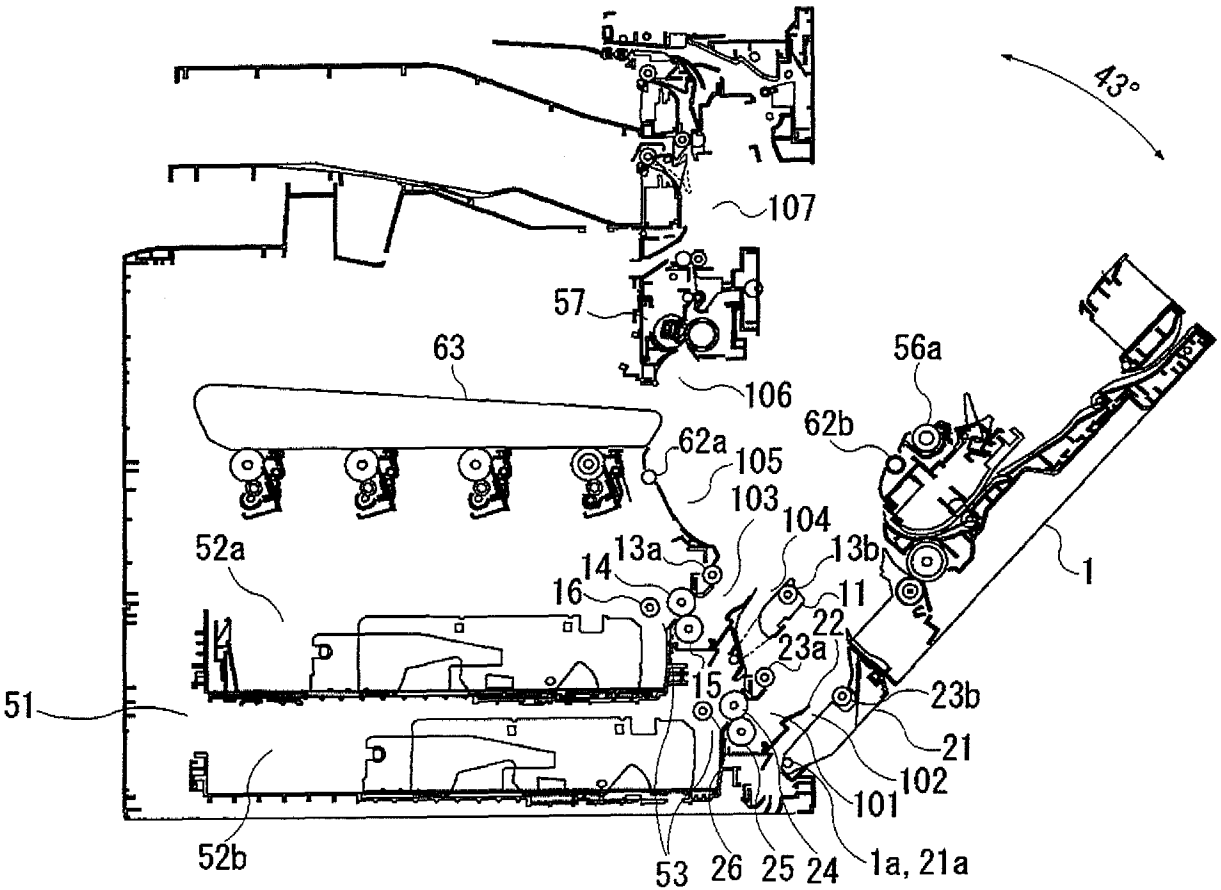
FIG. 3 is across sectional view illustrating movement of a first door according to the present invention.

Configurations of a first door 1 and a second door 21 according to the present invention will be described with reference to FIG. 3. The first door 1 is rotatably supported by a rotation shaft 1*a* that is horizontally disposed along a side face of the apparatus body 30 at the lower portion thereof. Thus, the first door 1 can be opened from the top thereof.

The second door 21 is mounted to the first door 1 in an openable/closable manner using a rotation shaft 21*a* that is coaxial with the rotation shaft 1*a* of the first door 1, at the lower portion of the side face of the apparatus body 30. More specifically, an axis line of the rotation shaft 21*a* is oriented in the same direction as that of the rotation shaft 1*a*, and the axis lines are set to be coaxial. The second door 21 is also opened from the top thereof. The doors 1 and 21 are thus configured to be opened from the same side thereof relative to the rotation shaft 1*a* and the rotation shaft 21*a* respectively. The rotation shaft 1*a* and the rotation shaft 21*a* are disposed at a position below the retard rollers 25 provided to the sheet feed units 53. Accordingly, the first and second conveyance paths 101 and 102 lie close to the rotation shaft 1*a*. The first door 1 and the second door 21 each have a width larger than a maximum width of a sheet relative to the sheet conveyance direction.

As illustrated in FIG. 1, a lever 2 is provided at a position closer to a user on the right side face of the first door 1. The first door 1 can be opened from the apparatus body 30 by operating the lever 2 to rotate and disengage a hook 3 (illustrated in FIG. 4) from a latching pin (not illustrated). At this time, another hook (not illustrated) is engaged with a latching pin (not illustrated) in the first door 1, so that the second door 21 is kept closing to the first door 1. The second door 21 can be rotated and opened from the first door 1 by operating a lever 27 provided at the upper portion of the second door 21 to disengage the hook from the latching pin.

The registration roller pair 62 includes a driving registration roller 62*a* and a driven registration roller 62*b*. The driven registration roller 62*b* of the registration roller pair 62 is provided to the first door 1, so that opening of the first door 1 relative to the apparatus body 30 clears a nip of the registration roller pair 62. The first door 1 is also provided with a secondary transfer roller 56*a*.

Below the conveyance path, a swing guide 11 is provided, and forms a part of the third conveyance path 103 and the fourth conveyance path 104. The swing guide 11 is pressed toward a drawing roller 13*a* by the first door 1 when the first door 1 is closed to the apparatus body 30. A drawing roller pair 13 draws the sheet fed from the first cassette 52*a* by the sheet feed unit 53, and includes a driving drawing roller 13*a* and a driven drawing roller 13*b* which is mounted to the swing guide 11.

When the first door 1 is opened from the apparatus body 30, the swing guide 11 rotates by it own weight, which makes the third conveyance path 103 and the fourth conveyance path 104 accessible.

The driven drawing roller 13*b* rotates together with the swing guide 11, so that a nip of the drawing roller pair 13 is cleared.

A drawing roller pair 23 draws sheets from the second cassette 52*b*, and includes a drawing roller 23*a* and a drawing roller 23*b*. The drawing roller 23*b* is mounted to the second door 21. In the present exemplary embodiment, the rotation shafts 1*a* and 21*a* of the two doors are coaxial. This configuration allows the first and second doors 1 and 21 to rotate together. If the rotation shafts 1*a* and 21*a* are not coaxial and the first and second doors 1 and 21 are to be rotated together, the first door 1 needs to have a rotation shaft 21*a*. This configuration, however, may deteriorate positional accuracy between the drawing roller 23*a* and the drawing roller 23*b* provided to the second door 21. According to the present exemplary embodiment, the rotation shafts 1*a* and 21*a* of the two doors are coaxial, so that the positional accuracy between the drawing roller 23*a* and the drawing roller 23*b* provided to the second door 21 can be maintained. When the first door 1 is opened from the apparatus body 30, the second door 21 can rotate together with the first door 1 and clears the nip of the drawing roller pair 23.

A swing guide 22 is pressed toward the retard roller 25 of the sheet feed unit 53 by the second door 21 when the second door 21 is closed to the apparatus body 30, and forms a part of the first conveyance path 101 and the second conveyance path 102. When the first door 1 is opened from the apparatus body 30, the swing guide 22 rotates by its own weight, which makes the first conveyance path 101 accessible.

Accordingly, the first to seventh conveyance paths 101 to 107 become accessible simultaneously by opening the first door 1 from the apparatus body 30, and nips of the registration roller pair 62, the drawing roller pair 13, and the drawing roller pair 23 are cleared. As a result, a jammed sheet can be easily found, and jam handling can be performed.

A flow for jam handling (hereinafter, referred to as jam handling flow) will be described. When a sheet is jammed, the image forming apparatus 20 stops conveying sheets. At this point, the jammed sheet and other sheet(s) in the conveyance path are remained in the apparatus body 30. Then, the screen of the monitor 42 in the document reading unit 41 is used to prompt a user to remove the sheets from the conveyance paths. In the present invention, there are two jam handling flows A and B, which will be described in detail below.

Jam handling flow A: in step 1, the first door 1 is opened. In step 2, the first door is closed, and the second door 21 is opened. In step 3, the sheet cassettes 52*a* and 52*b* are pulled out.

Jam handling flow B: in step 1, the second door 21 is opened. In step 2, the sheet cassettes 52*a* and 52*b* are pulled out.

Figure 4:
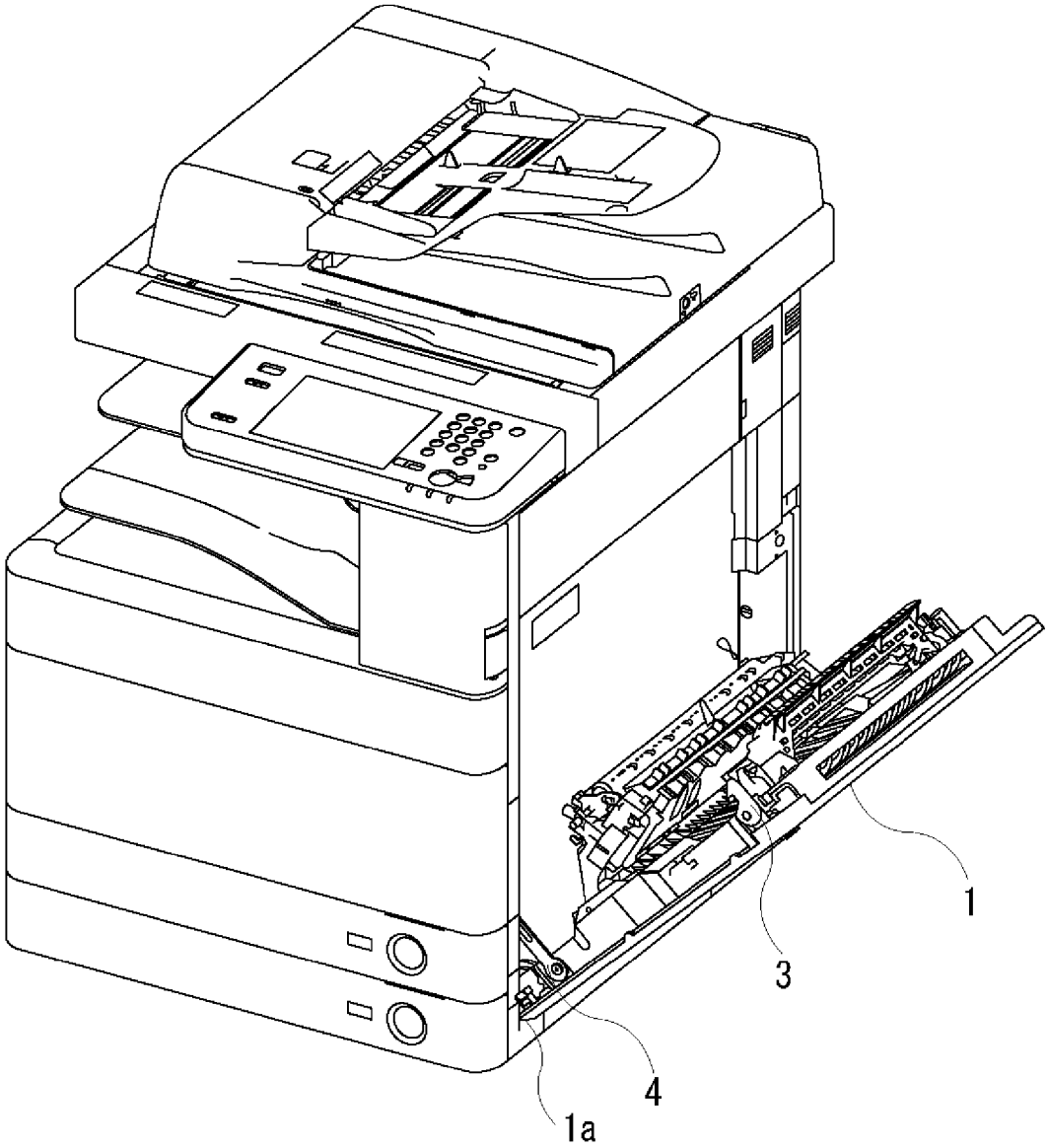
FIG. 4 is a perspective view illustrating movement of the first door according to the present invention.

The jam handling flow A will be described with reference to FIGS. 3 and 4. FIG. 4 is a perspective view illustrating the first door 1 that rotated from the apparatus body 30. The operations are performed in the order displayed on the monitor 42. First, the first door 1 is opened in step 1 (FIG. 3).

Accordingly, the first to seventh conveyance paths 101 to 107 of the apparatus body 30 are opened. When a user opens the first door 1 from the apparatus body 30 for jam handling, the user operates the lever 2 at the position close to the user on the right side face of the apparatus body 30 as illustrated in FIG. 1, to rotate and disengage the hook 3 from a latching pin (not illustrated). Thus the first door 1 is opened. The first door 1 can rotates around the rotation shaft 1*a* provided to the lower portion of the side face of the apparatus body 30 to a maximum rotation angle which is limited by a stopper 4 provided to the side face of the first door 1. The maximum rotation angle of the first door 1 in the present exemplary example is limited to 43 degrees.

In step 1, most of the sheets jammed or remained in the apparatus can be removed for jam handling. When a leading edge of the sheet is positioned around the conveyance path 101, the sheet can be found easily, but cannot be easily removed due to a distance between the top side of the first door 1 and the rotation shaft 1*a*. The distance hinders the user from reaching the sheet for jam handling to the rotation shaft 1*a* from the top side of the first door 1.

Figure 5:
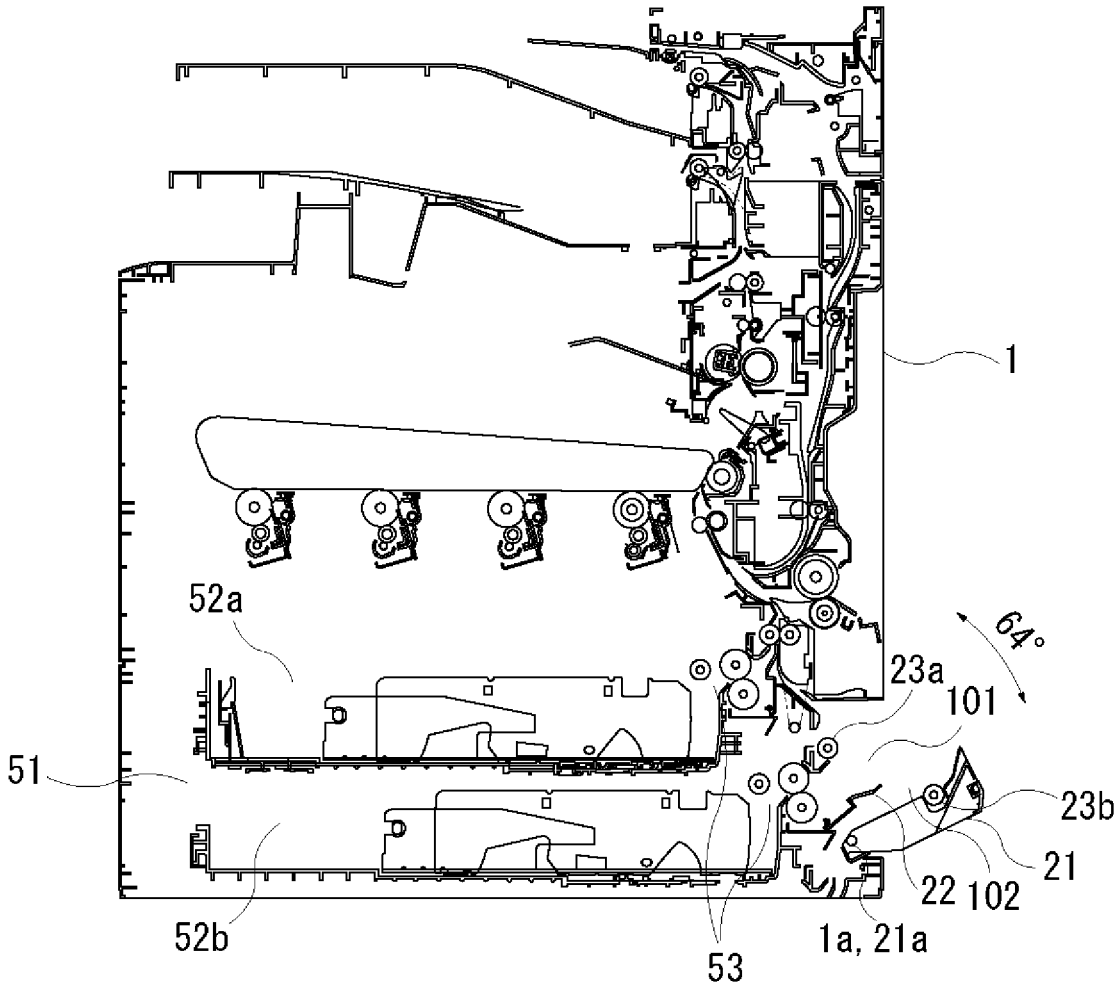
FIG. 5 is across sectional view illustrating movement of a second door according to the present invention.
Figure 6:
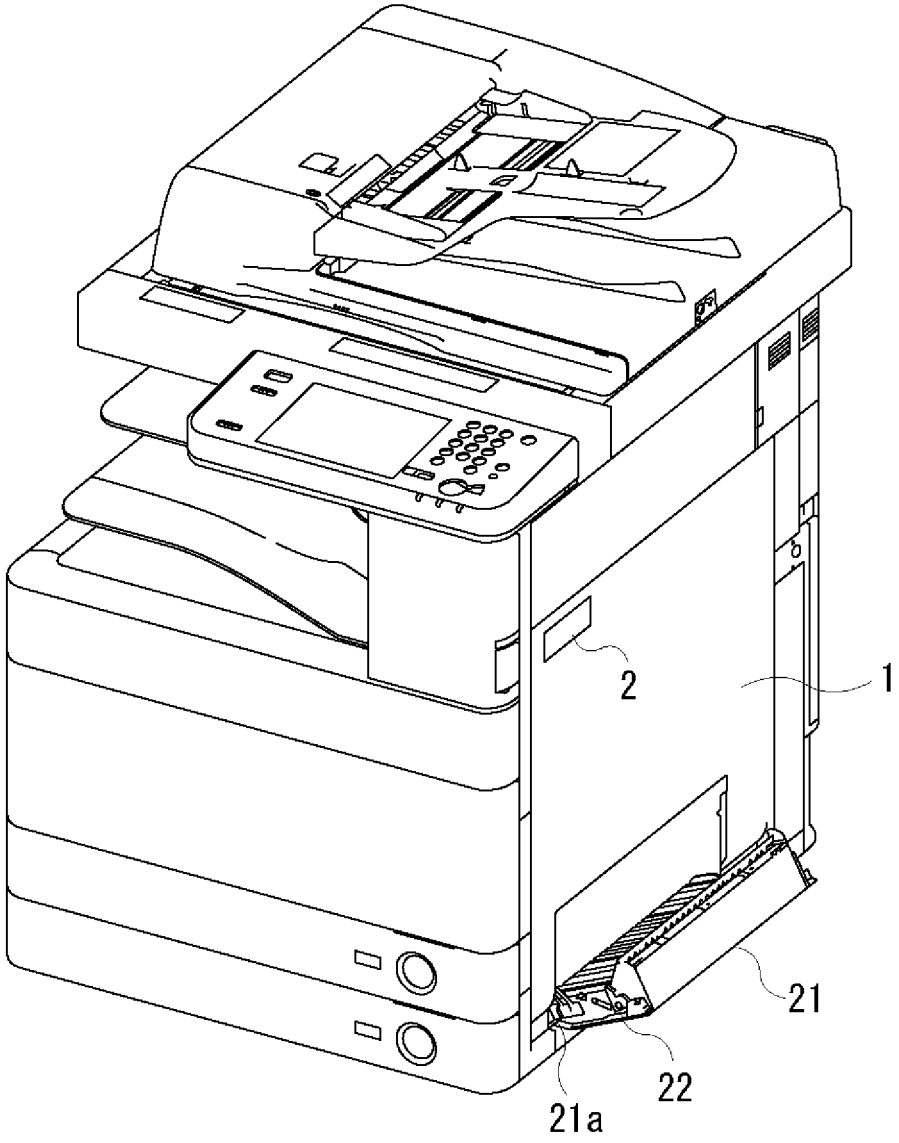
FIG. 6 is a perspective view illustrating movement of the second door according to the present invention.

In the case, after the removal of the sheets at accessible positions, the first door 1 is closed. Then, in step 2, the second door 21 is opened. By opening only the second door 21 as illustrated in FIGS. 5 and 6, the sheet that reached only the first conveyance path 101 at the leading edge thereof can be easily removed for jam handling. The second door 21 can rotate to a maximum rotation angle which is set large enough for securing a work space. The maximum rotation angle of the second door in the present exemplary embodiment is 64 degrees. After the removal of the sheet around the first conveyance path 101, in step 3, the sheet cassette 52*b* (or 52*a*) is pulled out to align the sheets in the sheet cassette 52*b* (or 52*a*). The jam handling flow A ends here. The sheet cassette 52*b* (or 52*a*) is then installed back to the apparatus body 30, and the second door 21 is closed.

The second door 21 has a small length in the vertical direction, so that any larger maximum rotation angle does not require extra installation space. The second openable/closable door also improves the operability for replacement of rollers, as well as jam handling.

The jam handling flow B will be described. The jam handling flow B is applied to the case where the sheet cassette 52*b* is used and a delay jam of a first sheet in a job occurs at the retard roller 25 of the sheet feed unit 53. The delay jam of the first sheet in the job occurs when the sheet does not reach a sheet detection sensor (not illustrated) that is disposed upstream side of the drawing roller pair 23 during a predetermined period of time after the sensor receives a first sheet-feed signal for feeding sheets from the sheet feed unit 53. In this case, there is no sheet that is jammed downstream therefrom, so that the first door 1 does not need to be opened.

The operations are performed in the order displayed on the monitor 42. First, the second door 21 is rotated in step 1 (FIG. 5). If a sheet is jammed around the first conveyance path 101, the sheet is removed. In step 2, the sheet cassette 52*b* is pulled out. The sheets in the sheet cassette 52*b*, if out of alignment, are aligned. The jam handling flow B ends here. The sheet cassette 52*b* is then installed back to the apparatus body 30, and the second door 21 is closed.

In the above described exemplary embodiment, the maximum rotation angle of the first door 1 is set to 43 degrees which can minimize the power required for closing the relatively heavy first door 1. The maximum rotation angle of the second door 21 is set to 64 degrees which provides excellent jam handling operability.

In the above described exemplary embodiment, the second door 21 rotates clockwise around the rotation shaft 21*a* relative to the first door 1 in FIG. 5. The second door 21 may be pulled out from the first door 1 to the right in FIG. 5. The rotation shaft 21*a* may be provided in a vertical direction at a back position of the apparatus body 30 in FIG. 5, so that the second door 21 can rotate toward the back in FIG. 5 relative to the first door 1.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-155303 filed Jun. 30, 2009, which is hereby incorporated by reference herein in its entirety.

What is claimed is:

1. An image forming apparatus comprising:

a sheet cassette, provided in an apparatus body, configured to store sheets;

a sheet feed unit, provided in the apparatus body, including a separating unit, configured to feed sheets, separated from the sheet cassette by the separating unit, one by one;

a conveyance unit, provided in the apparatus body, configured to convey a sheet fed from the sheet cassette by the sheet feed unit;

a first door, which is provided on the apparatus body in an openable/closable manner, and the first door provides access to the conveyance unit in the state of an open manner thereof;

a rotation shaft configured to rotatably support the first door; and a second door which is arranged interior to a perimeter of the first door, having an edge aligned with an edge of the first door, and in an openable/closable manner in a state of the close manner of the first door, wherein the second door provides access to a portion of the separating unit near the rotation shaft in a state of the open manner of the second door.

2. The image forming apparatus according to claim 1, further comprising, a second rotation shaft configured to rotatably support the second door, wherein the rotation shaft configured to rotatably support the first door is a first rotation shaft, wherein the second rotation shaft is disposed to have an axis line oriented in the same direction as that of an axis line of the first rotation shaft, and the first and second doors are opened from the same side thereof relative to the first rotation shaft and the second rotation shaft respectively.

3. The image forming apparatus according to claim 2, wherein the second door has a maximum rotation angle relative to the first door which is larger than a maximum rotation angle of the first door.

4. The image forming apparatus according to claim 2, wherein the first rotation shaft is coaxial with the second rotation shaft.

* * * * *